US012049903B2

(12) United States Patent
Hiradate et al.

(10) Patent No.: US 12,049,903 B2
(45) Date of Patent: Jul. 30, 2024

(54) MULTISTAGE CENTRIFUGAL COMPRESSOR

(71) Applicant: Hitachi Industrial Products, Ltd., Tokyo (JP)

(72) Inventors: Kiyotaka Hiradate, Tokyo (JP); Kazuhiro Tsukamoto, Tokyo (JP); Yuta Mochizuki, Tokyo (JP); Hiromi Kobayashi, Tokyo (JP); Takahiro Nishioka, Tokyo (JP)

(73) Assignee: Hitachi Industrial Products, Inc., Tokyo (JP)

( * ) Notice: Subject to any disclaimer, the term of this patent is extended or adjusted under 35 U.S.C. 154(b) by 0 days.

(21) Appl. No.: 18/278,354

(22) PCT Filed: Sep. 21, 2021

(86) PCT No.: PCT/JP2021/034635
§ 371 (c)(1),
(2) Date: Aug. 22, 2023

(87) PCT Pub. No.: WO2022/180902
PCT Pub. Date: Sep. 1, 2022

(65) Prior Publication Data

US 2024/0151239 A1 May 9, 2024

(30) Foreign Application Priority Data

Feb. 25, 2021 (JP) ..... 2021-028493

(51) Int. Cl.
*F04D 29/28* (2006.01)
*F04D 17/12* (2006.01)
*F04D 29/44* (2006.01)

(52) U.S. Cl.
CPC ..... *F04D 29/286* (2013.01); *F04D 17/12* (2013.01); *F04D 29/441* (2013.01)

(58) Field of Classification Search
CPC ..... F04D 29/286; F04D 17/12; F04D 29/441; F04D 17/122; F04D 29/444; F05D 2240/122
See application file for complete search history.

(56) References Cited

U.S. PATENT DOCUMENTS 4,859,145 A * 8/1989 Sidransky ..... F04D 21/00 415/211.1
4,877,373 A * 10/1989 Bandukwalla ..... F04D 29/444 415/208.4

(Continued)

FOREIGN PATENT DOCUMENTS

JP 2001-200797 A 7/2001
JP 2015-94293 A 5/2015

(Continued)

OTHER PUBLICATIONS

International Search Report (PCT/ISA/210) issued in PCT Application No. PCT/JP2021/034635 dated Nov. 16, 2021 with English translation (4 pages).

(Continued)

*Primary Examiner* — Courtney D Heinle
*Assistant Examiner* — Andrew Thanh Bui
(74) *Attorney, Agent, or Firm* — Crowell & Moring LLP

(57) ABSTRACT

A multistage centrifugal compressor capable of maintaining and improving efficiency while having a static flow path with a reduced outer diameter is provided. Each of return flow paths is provided with a plurality of return vanes disposed in a circular cascade form centered on a center line of a rotational shaft. Each of the return vanes is disposed as a leading vane (8A) and a trailing vane (8B). The trailing vanes are offset toward the pressure surface side of the leading vanes in a circumferential direction and provided so as to guide a flow from the pressure surface side of the leading vanes to negative pressure surfaces of the trailing (Continued)

vanes. At least one of (1) maximum camber positions ($I_{c,max}$) of the leading vanes (8A), (2) circumferential angles γ formed by trailing edges (8A2) of the leading vanes and leading edges (8B2) of the trailing vanes in the circumferential direction centered on the center line of the rotational shaft, and (3) circumferential angles θ formed by the leading edges (8B2) of the trailing vanes and trailing edges (8B3) of the trailing vanes in the circumferential direction centered on the center line of the rotational shaft is changed in accordance with the positions of centrifugal compressor stages of the multistage centrifugal compressor.

18 Claims, 9 Drawing Sheets

(56) References Cited

U.S. PATENT DOCUMENTS 5,152,661 A * 10/1992 Sheets ..... F04D 29/544 415/208.4
5,417,547 A * 5/1995 Harada ..... F04D 29/448 415/208.4
7,448,852 B2 * 11/2008 Abdelwahab ..... F04D 29/444 415/211.1
2013/0259644 A1 10/2013 Kobayashi et al.
2018/0306203 A1 * 10/2018 Nasir ..... F01D 9/045
2020/0049155 A1 2/2020 Yamashita

FOREIGN PATENT DOCUMENTS

JP 2018-135836 A 8/2018
WO WO 2012/053495 A1 4/2012

OTHER PUBLICATIONS

Japanese-language Written Opinion (PCT/ISA/237) issued in PCT Application No. PCT/JP2021/034635 dated Nov. 16, 2021 with English translation (7 pages).
Japanese-language International Preliminary Report on Patentability (PCT/IPEA/409) issued in PCT Application No. PCT/JP2021/034635 dated Jul. 25, 2022, including Annexes with English translation (29 pages).

* cited by examiner

MULTISTAGE CENTRIFUGAL COMPRESSOR

TECHNICAL FIELD

The present invention relates to a multistage centrifugal compressor, and particularly relates to a multistage centrifugal compressor including a leading cascade and a trailing cascade as return vanes in return flow paths.

BACKGROUND ART

In response to recent growing demands for reducing environmental loads, a multistage centrifugal compressor is required to have higher efficiency and a wider operating range as compared with conventional techniques. Meanwhile, from the viewpoint of reducing the cost and saving a space in an operating area, there is a demand for downsizing the multistage centrifugal compressor. To achieve an improvement of the efficiency of the multistage centrifugal compressor, an increase in the operating range, and the downsizing, it is important to reduce the outer diameter of a static flow path. The static flow path in the multistage centrifugal compressor is a flow path disposed downstream of a discharge outlet of an impeller that rotates. The static flow path is constituted by a diffuser flow path and a return flow path. The return flow path is a flow path that removes a swirling component that has flowed through the diffuser flow path, and leads a flow without pre-swirl to an impeller in the next stage.

When the outer diameter of the static flow path is reduced, the flow path length of the return flow path constituting the static flow path is also reduced. Therefore, it is necessary to turn a flow within a shorter distance and remove pre-swirl of the flow. To efficiently turn the flow in the return flow path, vanes that are called return vanes are normally disposed at equal intervals in a circumstantial direction (see, for example, Patent Literature 1).

Patent Literature 1 describes a centrifugal turbo machine. To obtain the centrifugal turbo machine having return vanes having a shape capable of suppressing a reduction in efficiency at the time of downsizing, the centrifugal turbo machine has a configuration in which a flow flows from a diffuser into a return flow path through a turn section, return vanes in the return flow path are arranged in multiple circular cascade forms, and vane angles of return vanes (outer vanes disposed furthest upstream) at an inlet of the return flow path are different in an axis direction (height direction).

CITATION LIST

Patent Literature

PTL 1: Japanese Unexamined Patent Application Publication No. 2015-94293

SUMMARY OF INVENTION

Technical Problem

When the lengths of the return vanes in a radial direction are reduced in order to further downsize the centrifugal compressor, the amount of a flow required to turn between an inlet and an outlet of each return vane is relatively larger than the lengths of the vanes.

For the return vanes in the centrifugal turbo machine described in Patent Literature 1, it is necessary to increase the curvature of a camber line (line connecting points equidistant from upper and lower surfaces of each vane) on a cross section (vane shape) of each vane cut along a plane perpendicular to the axial direction of a main shaft (rotational shaft) for the downsizing of the centrifugal turbo machine, and there is a high possibility that flow separation may occur. In Patent Literature 1, since cascades of the return vanes are disposed in two stages, the flow separation can be avoided to some extent.

However, when it is considered to further downsize the centrifugal compressor, and only the shape of each vane is considered, a load acting on each vane is excessive. Therefore, even when vanes are arranged in two or three stages, a flow may separate from vane surfaces and there is a possibility that the efficiency may not be improved.

An object of the present invention is to provide a multistage centrifugal compressor capable of maintaining or improving efficiency while having a static flow path with a reduced outer diameter.

Solution to Problem

To solve the above-described problems, a multistage centrifugal compressor according to the present invention is configured as described in claims.

A specific example of the multistage centrifugal compressor according to the present invention includes a rotational shaft and a plurality of centrifugal impellers attached to the rotational shaft. In the specific example of the multistage centrifugal compressor according to the present invention, a plurality of centrifugal compressor stages are arranged in an axial direction of the rotational shaft, each of the centrifugal compressor stages includes one of the centrifugal impellers, a diffuser in which a fluid that has flowed out of the one centrifugal impeller flows in a centrifugal direction away from the rotational shaft, a return flow path that is disposed downstream of the diffuser and in which the fluid flows in a return direction toward the rotational shaft so that the fluid flows from the diffuser to a centrifugal impeller in a subsequent stage among the plurality of centrifugal impellers, and a turn section that changes the flow of the fluid, which has flowed through the diffuser, from the centrifugal direction to the axial direction of the rotational shaft, and further changes the flow of the fluid from the axial direction to the return direction, each of the return flow paths includes a plurality of return vanes disposed in a circular cascade form centered on a center line of the rotational shaft, each of the return vanes includes a plurality of vanes arranged as a leading vane and a trailing vane in a direction from an upstream side to a downstream side of the flow of the fluid in each of the return flow paths, the trailing vanes are offset toward a pressure surface side of the leading vanes in a circumferential direction and provided so as to guide the flow on the pressure surface side of the leading vanes toward negative pressure surfaces of the trailing vanes, and at least one of maximum camber positions of the leading vanes, circumferential angles $\gamma$ formed by trailing edges of the leading vanes and leading edges of the trailing vanes in the circumferential direction centered on the center line of the rotational shaft, and circumferential angles $\theta$ formed by the leading edges of the trailing vanes and trailing edges of the trailing vanes in the circumferential direction centered on the center line of the rotational shaft is changed according to positions of the centrifugal compressor stages of the multistage centrifugal compressor.

Advantageous Effects of Invention

According to the present invention, it is possible to obtain a multistage centrifugal compressor capable of maintaining or improving efficiency while having a static flow path with a reduced outer diameter.

Problems, configurations, and effects other than those described above will be clarified from the following description of embodiments.

DESCRIPTION OF EMBODIMENTS

Figure 1:
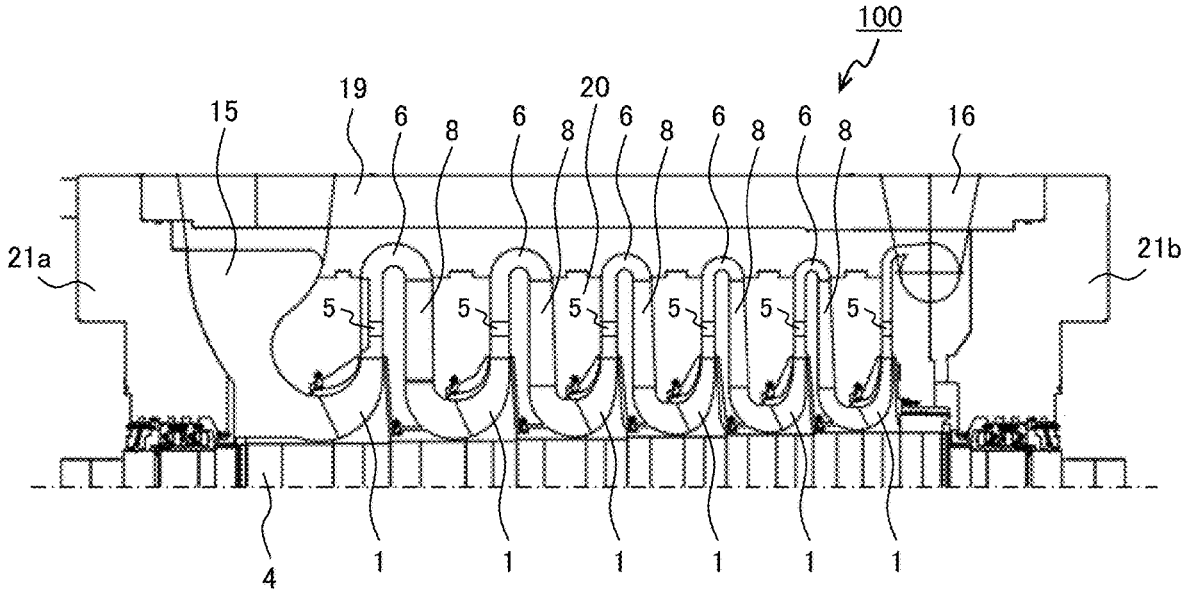
FIG. 1 is a meridional cross-sectional view illustrating an upper half of an example of an entire configuration of a multistage centrifugal compressor to which the present invention is applied.

First, an outline of a configuration according to an embodiment of the present invention is described before a detailed description of the embodiment of the present invention.

In a multistage centrifugal compressor that increases the pressure of various compressible gases, the pressure of a gas gradually increases as the gas flows from an upstream centrifugal compressor stage to a downstream centrifugal compressor stage. Therefore, as the gas flows from the upstream centrifugal compressor stage to the downstream centrifugal compressor stage, the density of the gas gradually increases due to the compressibility of the gas, but the volumetric flow rate of the gas gradually decreases. In the multistage centrifugal compressor, the volumetric flow rate of the gas that passes through each of stages varies in each of the stages, and thus the flow state of the gas in an internal flow path varies in each of the stages. According to the study of the present inventors and the like, in further downsizing of the multistage centrifugal compressor, to avoid flow separation in return vanes, it is necessary to consider not only a shape of a return vane in only one centrifugal compressor stage but also a shape based on a difference between flow states of the gas in the stages.

As a result of various studies by the present inventors and the like, the present inventors and the like found that, in a multistage centrifugal compressor having cascades (leading cascade and trailing cascade) in two stages as return vanes, at least one of (a) maximum camber positions of leading vanes, (b) ratios of maximum cambers to lengths of chord lines of the leading vanes, (c) angles (circumferential angles $\gamma$) formed by trailing edges of the leading vanes and leading edges of trailing vanes in a circumferential direction centered on a center line of a rotational shaft, and (d) angles (circumferential angles $\theta$) formed by the leading edges of the trailing vanes and trailing edges of the trailing vanes in the circumferential direction centered on the center line of the rotational shaft was changed (optimized) based on a difference between volumetric flow rates in the stages according to the positions of the centrifugal compressor stages of the multistage centrifugal compressor (in other words, in each of the stages).

Hereinafter, a multistage centrifugal compressor according to an embodiment of the present invention is described with reference to the drawings. In the drawings, the same reference signs are used for the same constituent components.

First, an example of a configuration of the multistage centrifugal compressor to which the present invention is applied is described with reference to FIGS. 1 to 3.

As illustrated in FIG. 1, a multistage centrifugal compressor 100 is substantially constituted by centrifugal impellers 1 that give rotational energy to a fluid, a rotational shaft 4 to which the centrifugal impellers 1 are attached, and diffusers 5 located radially outside the centrifugal impellers 1 and configured to convert dynamic pressure of the fluid that has flowed out of the centrifugal impellers 1 to static pressure. In addition, return flow paths 6 that guide the fluid to the centrifugal impellers 1 in subsequent stages are provided downstream of the diffusers 5.

Figure 2:
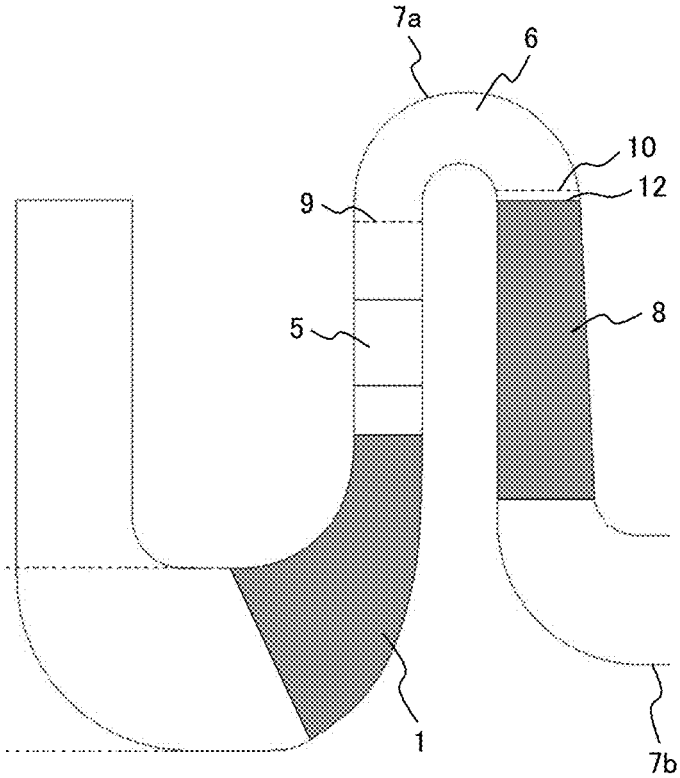
FIG. 2 is a partial enlarged cross-sectional view of the multistage centrifugal compressor illustrated in FIG. 1.
Figure 3:
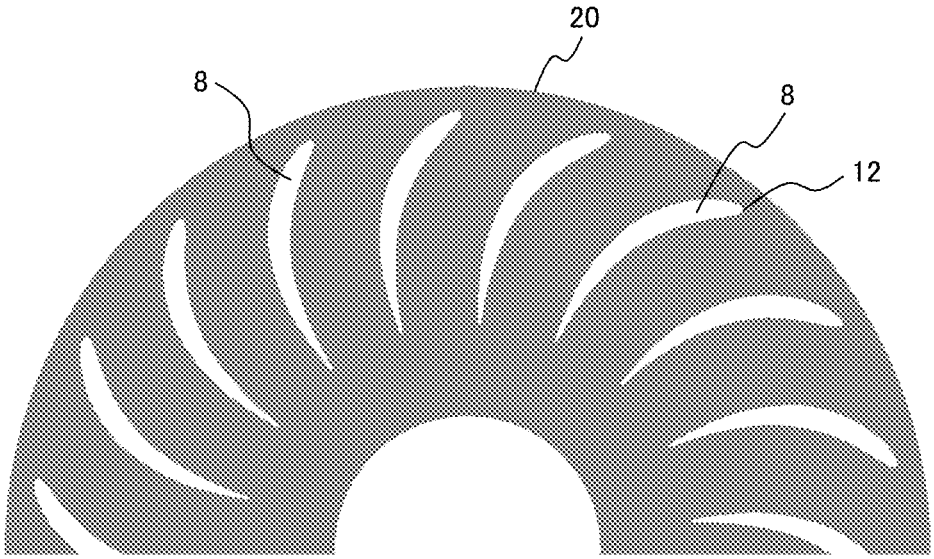
FIG. 3 is a diagram illustrating a half of a periphery of return vanes illustrated in FIGS. 1 and 2 as viewed from a downstream side in an axial direction of a rotational shaft.

Although not particularly illustrated in the drawings, normally, each of the centrifugal impellers 1 includes a disk (hub) coupled to the rotational shaft 4, a side plate (shroud) disposed facing the hub, and a plurality of vanes located between the hub and the shroud and arranged at intervals in the circumferential direction (direction perpendicular to the sheet surface of FIG. 2).

As each of the diffusers 5, a vaned diffuser with a plurality of vanes arranged at substantially equal intervals in the circumferential direction or a vaneless diffuser not having a vane is used. In FIG. 2, the vaned diffuser is used.

In addition, each of the return flow paths 6 includes return vanes 8 and turn sections 7*a* and 7*b* configured to change a flow of the fluid, which has flowed through the diffuser 5, from a centrifugal direction to an axial direction, and to further change the flow of the fluid from the axial direction to a return direction (see FIG. 2). The return vanes 8 change the flow of the fluid, which has passed through the diffusers 5 from an outward direction to an inward direction in a radial direction. Further, the return vanes 8 remove a swirling component of the fluid and cause the fluid to flow into the centrifugal impellers 1 located in the subsequent stages while rectifying the fluid. The return vanes 8 are arranged in a circular cascade form centered on the center line of the rotational shaft as illustrated in FIG. 3.

As illustrated in FIG. 2, the turn sections 7*a* and 7*b* that change the flow from the axial direction to the return direction are formed as U-shaped curved flow paths surrounded by a peripheral structure in a meridional plane. The turn section 7*a* is defined as a section extending from a turn section inlet 9 to a turn section outlet 10. The turn section inlet 9 is defined as a substantially cylindrical plane corresponding to an outlet of the diffuser 5. The turn section outlet 10 is defined as a substantially cylindrical plane corresponding to an end of a meridional curved flow path located immediately upstream of leading edges 12 of the return vanes.

The return vanes 8 are a plurality of vanes arranged at substantially equal intervals in the circumferential direction around the rotational shaft 4. In addition, although not particularly illustrated in the drawings, radial bearings rotatably supporting the rotational shaft 4 are disposed at both edges of the rotational shaft 4 in the centrifugal compressor 100.

In addition, the centrifugal impellers (six impellers in FIG. 1) 1 in the multiple compressor stages are attached to the rotational shaft 4. The diffusers 5 and the return flow paths 6 are disposed downstream of each of the centrifugal impellers 1 as illustrated in FIG. 2.

The centrifugal impellers 1, the diffusers 5, and the return flow paths 6 are housed in a casing 19 and a diaphragm 20. The casing 19 is supported by flanges 21*a* and 21*b*. In addition, a suction flow path 15 is disposed on the suction side of the casing 19, and a discharge flow path 16 is disposed on the discharge side of the casing 19.

As illustrated in FIG. 1, in the multistage centrifugal compressor 100 configured in the above-described manner, as the fluid suctioned from the suction flow path 15 passes through the centrifugal impeller 1, the diffuser 5, and the return flow path 6 in each of the stages, the pressure of the fluid increases. The pressure of the fluid finally increases to predetermined pressure and the fluid is discharged from the discharge flow path 16.

As described above, in the multistage centrifugal compressor 100 configured in the above-described manner, when the lengths of the return vanes 8 in the radial direction are reduced in order to further downsize the centrifugal compressor, the amount of the fluid required to turn between the outlets and the inlets of the return vanes 8 relatively increases with respect to the lengths of the return vanes 8 in the radial direction, and thus the flow separation may occur and there is a possibility that the efficiency may not be improved.

A multistage centrifugal compressor 100 according to the present embodiment solves this problem, and will be described in detail with reference to FIGS. 4 to 11.

Figure 4:
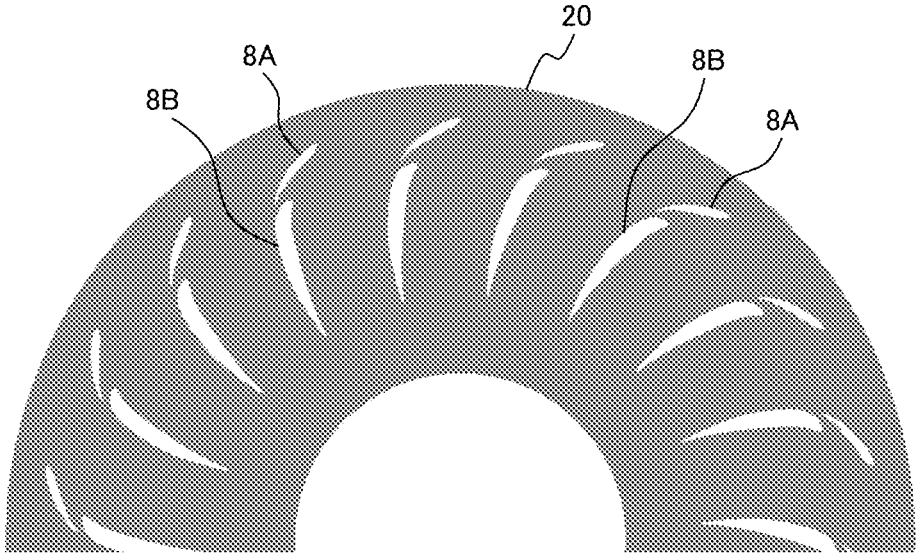
FIG. 4 is a diagram illustrating a half of a periphery of return vanes according to an embodiment of the present invention as viewed from a downstream side in an axial direction of a rotational shaft.
Figure 5:
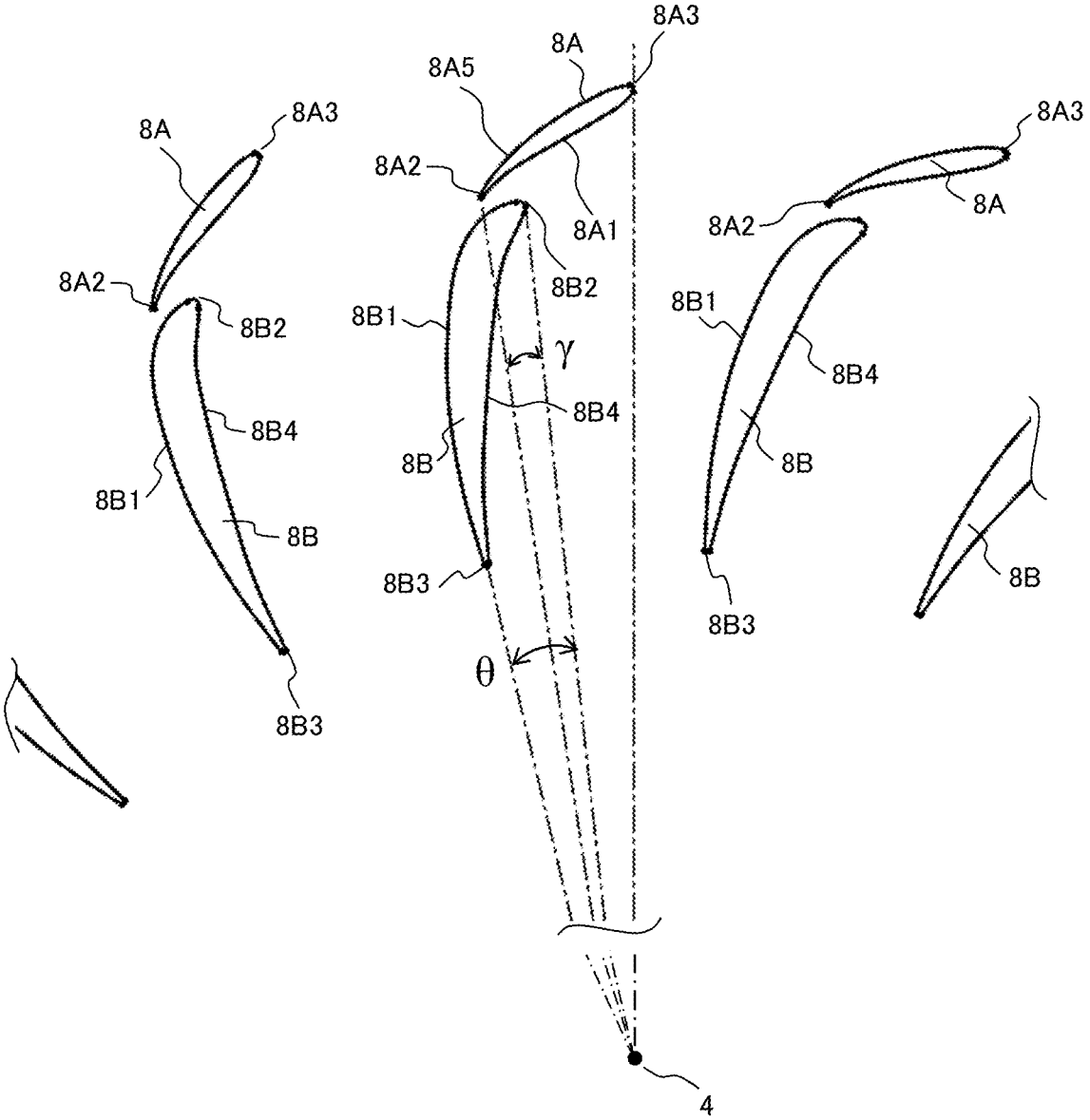
FIG. 5 is a schematic diagram illustrating a positional relationship between leading vanes and tailing vanes of the return vanes according to the embodiment of the present invention.

FIG. 4 is a diagram illustrating a half of a periphery of the return vanes 8 in any stage in the multistage centrifugal compressor 100 according to the embodiment of the present invention as viewed from a downstream side in an axial direction of the rotational shaft 4. FIG. 5 is a schematic diagram illustrating a positional relationship between leading vanes 8A and trailing vanes 8B of the return vanes 8 in the multistage centrifugal compressor 100 according to the embodiment of the present invention.

In the multistage centrifugal compressor 100 according to the present embodiment illustrated in FIGS. 4 and 5, the return vanes 8 formed in multiple circular cascades include return vanes arranged in two rows in a direction from the upstream side to the downstream side of the flow of the fluid in the return flow paths 6. In the present embodiment, the plurality of airfoil-type return vanes 8 in the return flow paths 6 are arranged in the circumferential direction as leading cascades on the upstream side and trailing cascades on the downstream side in the return flow paths 6. The trailing vanes 8B of the return vanes 8 are offset toward the pressure surface 8A1 side of the leading vanes 8A in the circumferential direction and are provided so as to guide the flow on the pressure surface 8A1 side of the leading vanes 8A to negative pressure surfaces 8B1 of the trailing vanes 8B of the return vanes 8. The fluid flowing in the vicinity of a vane surface of the pressure surface 8A1 of the leading vane 8A flows such that a thickness of a velocity boundary layer grown on the vane surface is smaller and the fluid has higher energy, as compared with the fluid flowing in the vicinity of a vane surface of a negative pressure surface 8A5 of the leading vane 8A. Therefore, since the fluid flowing in the vicinity of the vane surface of the pressure surface 8A1 of the leading vane 8A having high energy is guided to a location in the vicinity of the vane surface of the negative pressure surface 8B1 of the trailing vane 8B, it is possible to suppress the growth of the velocity boundary layer on the vane surface of the negative pressure surface 8B1 of the trailing vane 8B and suppress the flow separation on the vane surface of the negative pressure surface 8B1.

Figure 6:
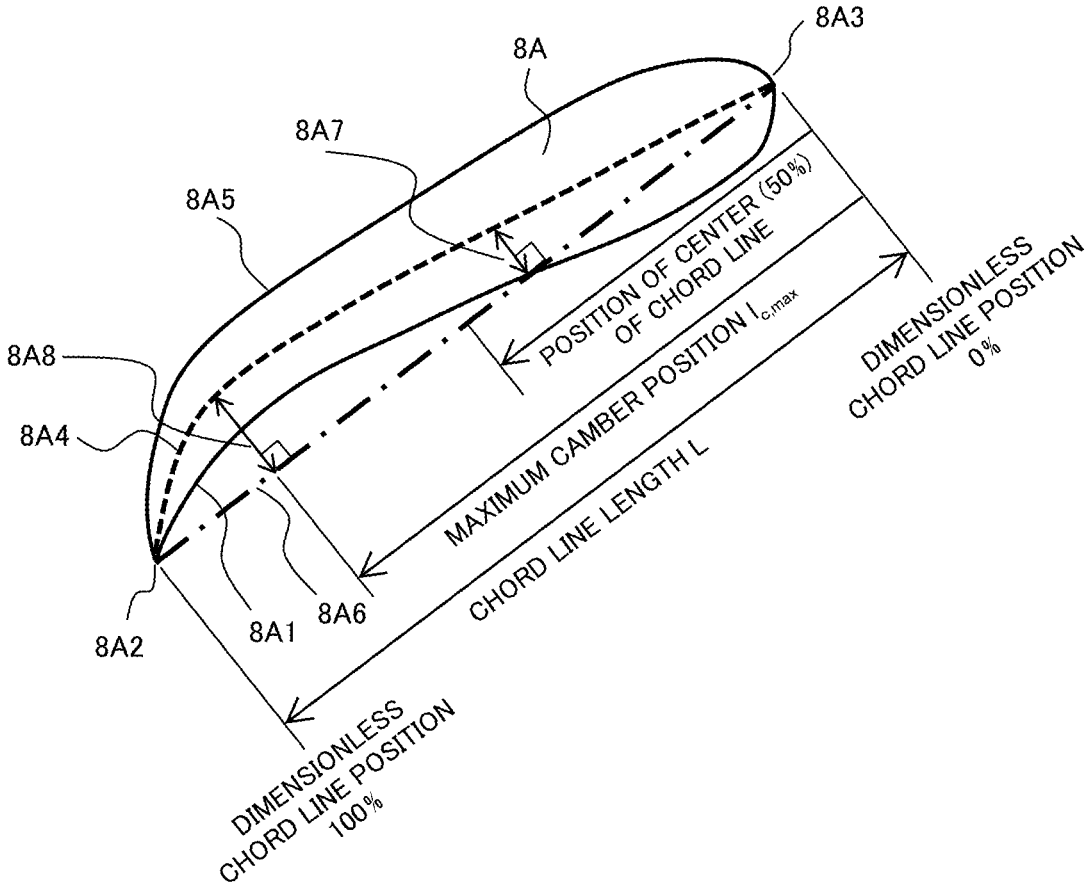
FIG. 6 is a diagram illustrating a shape feature of a leading vane of a return vane in the first stage according to the embodiment of the present invention.
Figure 7:
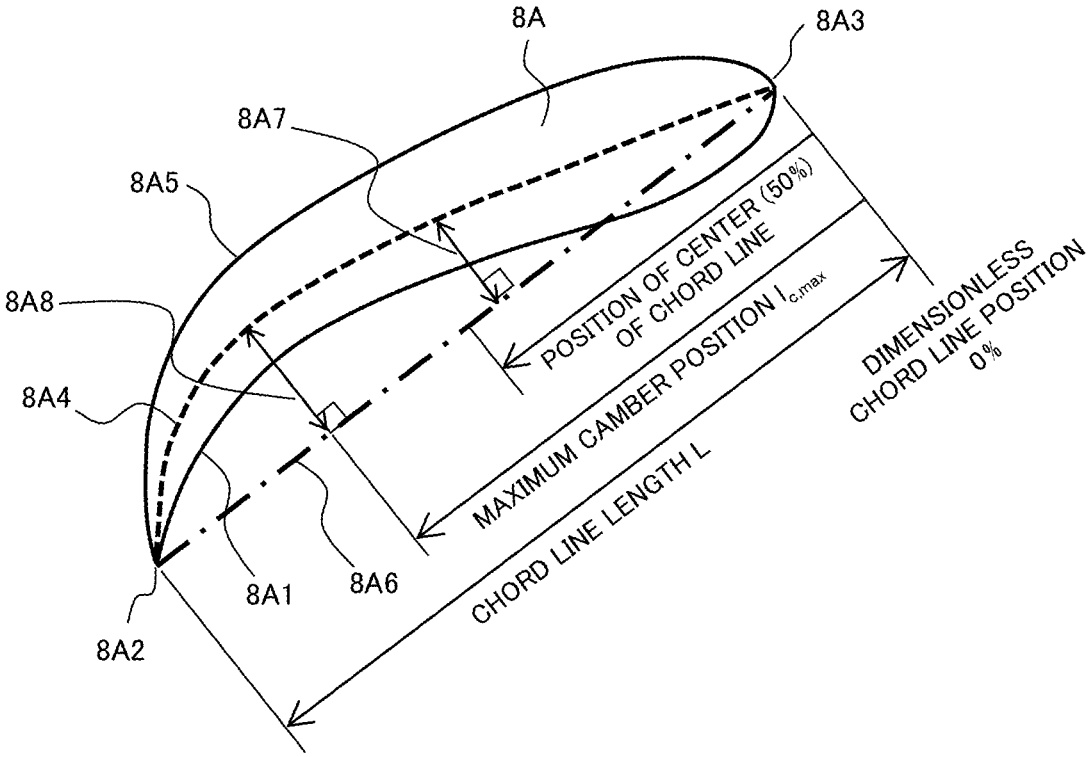
FIG. 7 is a diagram illustrating a shape feature of a leading vane of a return vane in an intermediate stage located between the first stage and the last stage according to the embodiment of the present invention.
Figure 8:
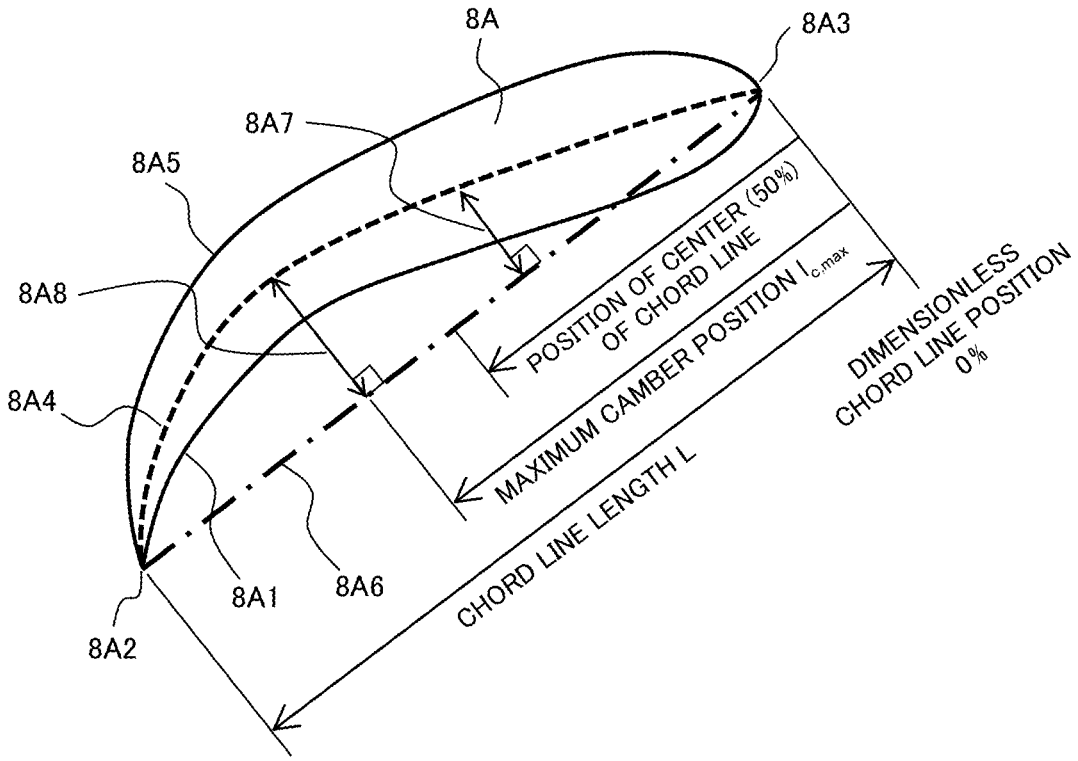
FIG. 8 is a diagram illustrating a shape feature of a leading vane of a return vane in the last stage according to the embodiment of the present invention.

FIGS. 6 to 8 are diagrams illustrating shape features of the leading vanes 8A of the return vanes 8 according to the present embodiment. FIG. 6 illustrates a shape feature of the leading vane 8A in the first stage in the multistage centrifugal compressor 100 according to the present embodiment. FIG. 7 illustrates a shape feature of the leading vane 8A in an intermediate stage located between the first stage and the last stage in the multistage centrifugal compressor 100 according to the present embodiment. FIG. 8 illustrates a shape feature of the leading vane 8A in the last stage in the multistage centrifugal compressor 100 according to the present embodiment. In this case, the last stage of the multistage centrifugal compressor 100 is the last stage among the compressor stages including the return flow paths (hereinafter the same applies).

A dashed-dotted line 8A6 illustrated in the drawing indicates a chord line that is a straight line connecting a leading edge 8A3 of the leading vane 8A to a trailing edge 8A2 of the leading vane 8A. A dotted line 8A4 illustrated in the drawing indicates a camber line (line connecting points equidistant from upper and lower surfaces of the vane) of the leading vane 8A. In addition, an arrow 8A7 illustrated in the drawing indicates a camber of the leading vane 8A that is a distance from a perpendicular line extending from any position on the chord line 8A6 and perpendicular to the chord line 8A6 to the camber line 8A4. In addition, an arrow 8A8 illustrated in the drawing indicates a maximum camber that is the maximum camber of the leading vane 8A. Hereinafter, the maximum camber is represented as a ratio to the length (chord line length L) of the chord line 8A6.

A distance from the leading edge 8A3 of the leading vane 8A to the maximum camber 8A8 on the chord line 8A6 is referred to as a maximum camber position $I_{c,\ max}$. The maximum camber position $I_{c,\ max}$ is represented as a ratio (dimensionless chord line position) to the chord line length L. In this case, the leading edge 8A3 of the leading vane 8A corresponds to a position where the dimensionless chord line position is 0%, while the trailing edge 8A2 corresponds to a position where the dimensionless chord line position is 100%.

As illustrated in FIGS. 6 to 8, in the present embodiment, (a) each of the leading vanes 8A of the return vanes 8 is configured such that the maximum camber positions $I_{c,\ max}$ of the leading vanes 8A in the first stage of the multistage centrifugal compressor 100 are on the most trailing edge side among those in the stages of the multistage centrifugal compressor 100 and such that as the stage is located further downstream, the maximum camber positions $I_{c,\ max}$ gradually become closer to the leading edges 8A3 of the leading vanes 8A. In addition, (b) the leading vanes 8A of the return vanes 8 are configured such that the maximum cambers 8A8 of the leading vanes 8A in the first stage of the multistage centrifugal compressor 100 are the smallest as compared with the other stages and such that as the stage is located further downstream, the maximum cambers 8A8 gradually become larger. In other words, as the stage is located further downstream, the ratio of the maximum camber 8A8 to the chord line length L of each of the leading vanes 8A gradually becomes higher. Note that it is preferable that (b) the ratio of the maximum cambers 8A8 to the chord line length L of each of the leading vanes 8A be set as described above while the above-described configuration with (a) the maximum camber positions $I_{c,\ max}$ of the leading vanes 8A is satisfied.

In the present embodiment, an effect of setting the leading vanes 8A of the multistage centrifugal compressor 100 in the above-described manner is as follows.

The multistage centrifugal compressor 100 gradually increases the pressure of the fluid from the first stage to the last stage. Thus, the density of the fluid gradually increases from the first stage to the last stage due to the compressibility of the fluid compressed. Therefore, the volumetric flow rate of the fluid flowing in the multistage centrifugal compressor 100 is highest in the first stage and gradually becomes smaller toward the last stage.

Figure 9:
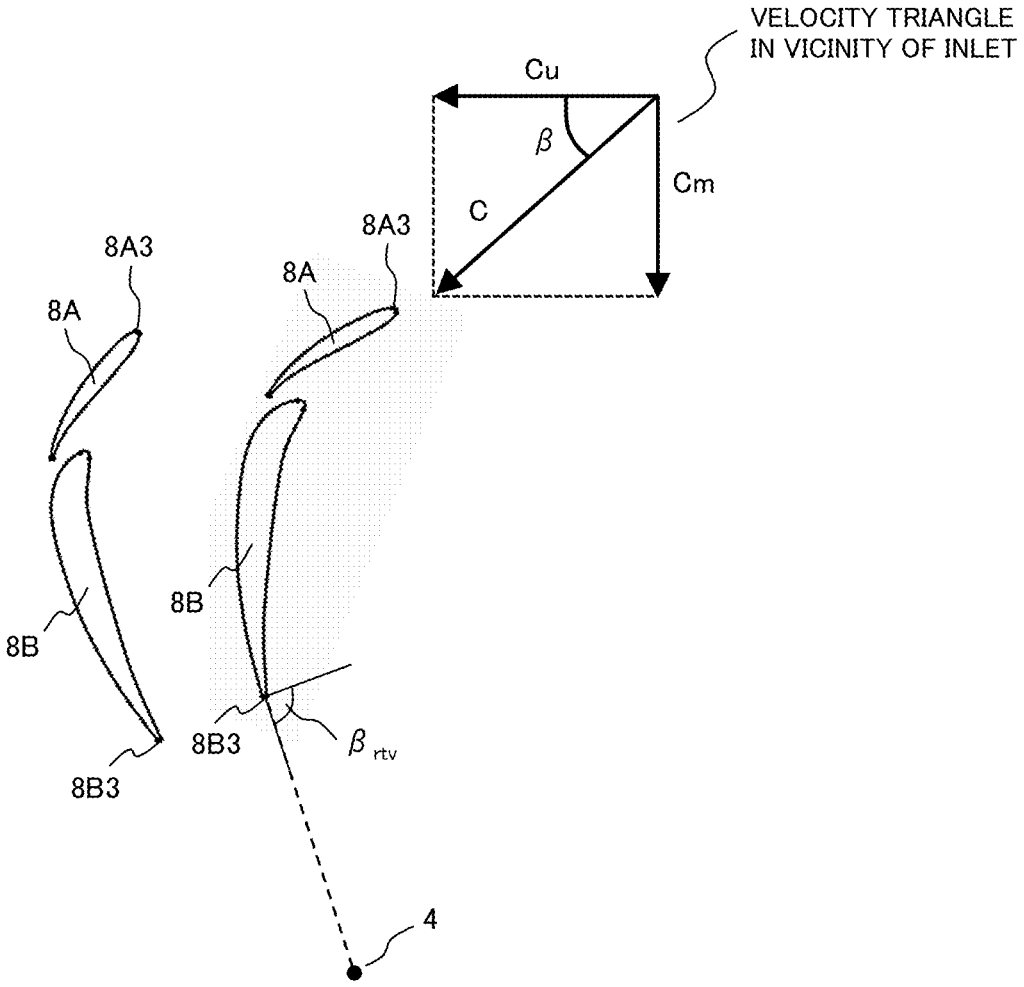
FIG. 9 is a diagram illustrating a velocity triangle of a fluid flowing in a leading vane of a return vane in the vicinity of an inlet of the leading vane according to the embodiment of the present invention.

FIG. 9 illustrates the leading edges 8A and the trailing edges 8B of the return vanes 8, and a velocity triangle of the fluid flowing in the leading vane 8A in the vicinity of the inlet (position where the vane has the same radius as that of the leading edge 8A3) of the leading vane 8A. In general, the multistage centrifugal compressor is configured such that heads in the stages are equivalent. A theoretical head $H_{th}$ of the impeller in each of the stages in a case where the fluid flowing in the impeller in each of the stages does not include a swirling component is expressed by Equation (1).

$$\text{The theoretical head } H_{th}=U_2\times Cu_2/g \qquad \text{Equation (1)}$$

Where $U_2$ indicates a circumferential velocity of the impeller in each of the stages, $Cu_2$ indicates a circumferential component of an absolute velocity of the fluid at an outlet of the impeller in each of the stages, and g is gravitational acceleration. In a case where the theoretical heads $H_{th}$ in the stages are equivalent, $U_2$ and $Cu_2$ are equivalent in each of the stages. Therefore, the circumferential component Cu of the absolute velocity indicated in the velocity triangle in the vicinity of the inlet of the leading vane 8A is equivalent in each of the stages.

As described above, the volumetric flow rate of the fluid flowing in the multistage centrifugal compressor 100 is the highest in the first stage, and gradually becomes lower toward the last stage. The volumetric flow rate of the fluid flowing in the compressor and a meridional component Cm of the absolute velocity of the fluid flowing in the compressor basically have a proportional relationship. Therefore, the meridional component Cm of the absolute velocity indicated in the velocity triangle in the vicinity of the inlet of the leading vane 8A is the largest in the first stage of the multistage centrifugal compressor 100 and gradually becomes smaller toward the last stage.

Based on features of the above-described Cu and Cm in each of the stages, an absolute flow angle R of the fluid in the vicinity of the inlet of the leading vane 8A is the largest in the first stage of the multistage centrifugal compressor 100 as compared with the downstream stages, and gradually becomes smaller as the stage is located further downstream. On the other hand, as illustrated in FIG. 9, in order for the fluid flowing in the impeller in the subsequent stage not to have a swirling component, vane angles $\beta_{rtv}$ at the trailing edges 8B3 of the trailing vanes 8B are set as $\beta_{rtv}=90°$ so as to orient the vane trailing edges toward the rotational shaft 4 in many cases. Therefore, a turning angle (difference between $\beta_{rtv}$ and $\beta$) of the fluid that the return vanes 8 need to obtain in a space from the leading edges 8A3 of the leading vanes 8A to the trailing edges 8B3 of the trailing vanes 8B is the smallest in the first stage of the multistage centrifugal compressor 100 as compared with the downstream stages, and gradually becomes larger as the stage is located further downstream.

In the present embodiment, the magnitudes of turning angles of the fluid that the return vanes 8 need to obtain are different for each of the stages, and to support the magnitudes of the turning angles of the fluid, the leading vanes 8A of the return vanes 8 are configured such that the maximum camber positions $I_{c,\ max}$ of the leading vanes 8A are located on the most trailing edge side in the first stage of the multistage centrifugal compressor 100 as compared with the other stages of the multistage centrifugal compressor 100, and gradually become closer to the leading edges 8A3 of the leading vanes 8A as the stage is located further downstream. In addition, the leading vanes 8A of the return vanes 8 are configured such that the maximum cambers 8A8 of the leading vanes 8A are the smallest in the first stage as compared with the other stages of the multistage centrifugal compressor 100, and gradually become larger as the stage is located further downstream. Each of the maximum camber positions $I_{c,\ max}$ is an index indicating a dimensionless chord line position where a vane load in the leading vane 8A is the largest and indicating the amount of the fluid started to be turned from the leading edge 8A3 side. In addition, each of the maximum cambers 8A8 indicates the magnitude of the vane load in the leading vane 8A. Therefore, the closer the maximum camber position $I_{c,\ max}$ is to 0% and the larger the maximum camber 8A8, the larger the turning angle of the fluid obtained in the leading vane 8A. Therefore, as in the present embodiment, since the maximum camber positions $I_{c,\ max}$ of the leading vanes 8A and the maximum cambers 8A8 are set, the turning angle of the fluid obtained in the leading vanes 8A in the first stage of the multistage centrifugal compressor 100 can be the smallest, the turning angle of the fluid obtained in the leading vanes 8A can gradually become larger as the stage is located further downstream, and it is possible to obtain turning angles of the fluid that the return vanes 8 need to obtain. In this case, the turning angles of the fluid are different in the stages.

In addition, in this case, it is preferable that, in any of the stages, the maximum camber position $I_{c,\ max}$ be on a second half part (on the trailing edge 8A2 side of a position corresponding to a dimensionless chord line position 50%) of the chord line 8A6. An effect of this configuration is as follows.

That is, as illustrated in FIGS. 6 to 8, the camber line 8A4 of the leading vane 8A is rapidly curved in the vicinity of the trailing edge 8A2. Therefore, as illustrated in FIG. 5, the direction of the flow along the pressure surface 8A1 of the leading vane 8A is a direction toward the negative pressure surface 8B1 of the trailing vane 8B. Due to this flow, the flow flowing along the negative pressure surface 8B1 of the trailing vane 8B is confined toward the vane surface, and the flow separation that occurs on the negative pressure surface 8B1 of the trailing vane 8B is suppressed. By suppressing the flow separation, it is possible to suppress a reduction in the efficiency due to the flow separation and to turn the flow.

When the camber line 8A4 of the leading vane 8A is rapidly curved, the flow separation may easily occur in the vicinity of this curved portion on the negative pressure surface 8A5 of the leading vane 8A. However, in the present embodiment, the rapid curve of the camber line of the leading vane 8A is limited to the vicinity of the trailing edge 8A2, a region in which the flow separation occurs on the negative pressure surface 8A5 is limited to a region in the vicinity of the trailing edge 8A2. Therefore, while an increase in a loss of the pressure in the leading vane 8A is minimized, it is possible to efficiently suppress the flow separation on the negative pressure surface 8B1 of the trailing vane 8B.

In the above description, the leading vanes 8A of the return vanes 8 are configured such that the maximum camber positions $I_{c,\ max}$ of the leading vanes 8A gradually become closer to the leading edge 8A3 side from the trailing edges 8A2 side toward the last stage from the first stage of the multistage centrifugal compressor 100 and such that the maximum cambers 8A8 of the leading vanes 8A gradually become larger toward the last stage from the first stage of the multistage centrifugal compressor 100. However, the Mach number of the fluid compressed by the multistage centrifugal compressor 100 may be low and an effect of the compressibility of the fluid can be almost ignored. In such a case, the maximum camber positions $I_{c,\ max}$ of the leading vanes 8A in two or more adjacent stages among the stages of the multistage centrifugal compressor 100 may be the same. In addition, the maximum cambers 8A8 of the leading vanes 8A in two or more adjacent stages among the stages of the multistage centrifugal compressor 100 may be the same. In other words, when the first stage is compared with at least the last stage, the leading vanes 8A of the return vanes 8 may be configured such that the maximum camber positions $I_{c,\ max}$ of the leading vanes 8A in the first stage are located on the most trailing edge 8A2 side and the maximum camber positions $I_{c,\ max}$ of the leading vanes 8A in the last stage are located on the most leading edge 8A3 side and such that the maximum cambers 8A8 of the leading vanes 8A in the first stage are the smallest and the maximum cambers 8A8 of the leading vanes 8A in the last stage are the largest.

Figure 10:
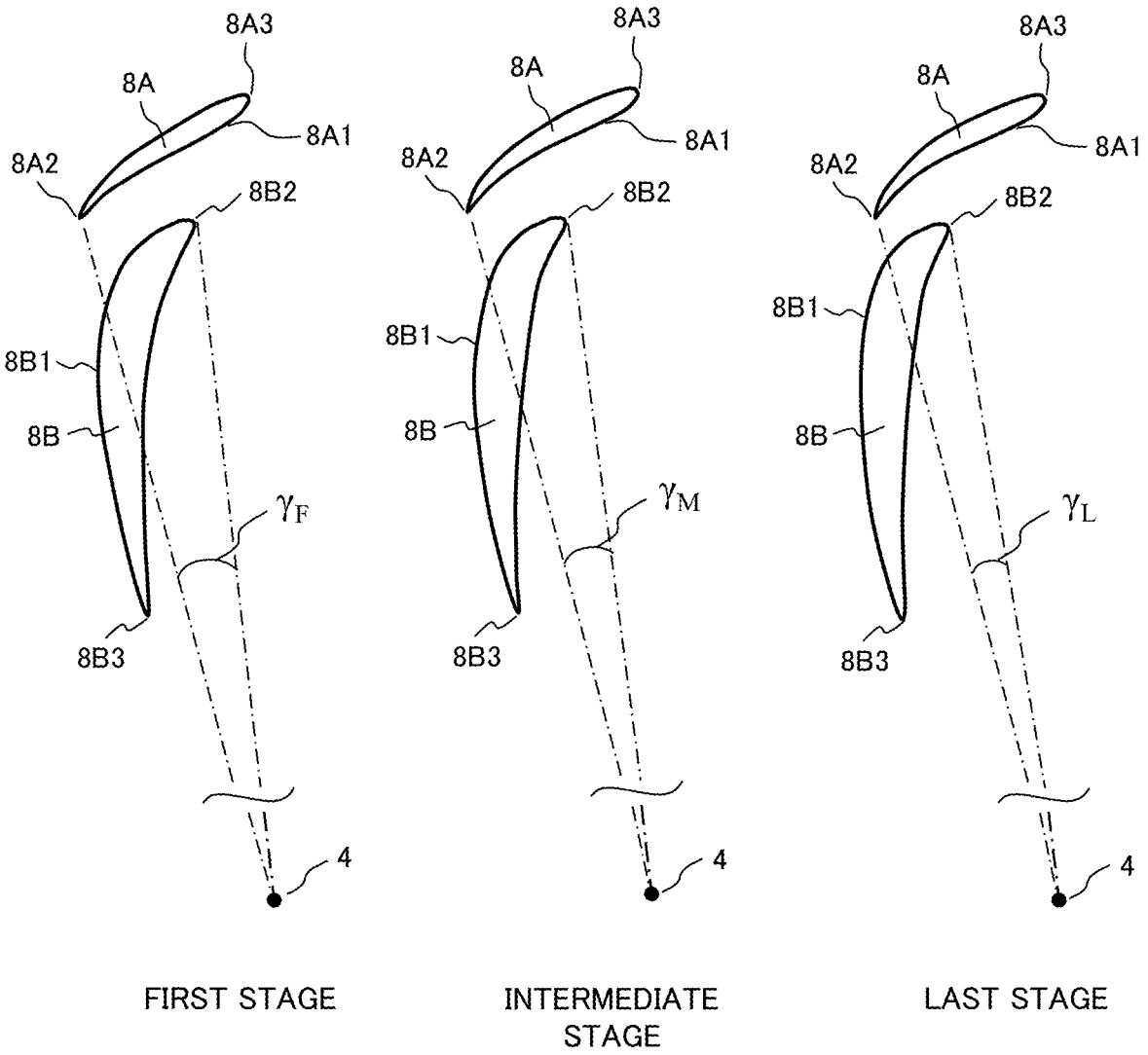
FIG. 10 is a diagram illustrating shape features of pairs of leading and trailing vanes constituting return vanes in the first stage, the intermediate stage located between the first stage and the last stage, and the last stage according to the embodiment of the present invention.

Subsequently, a positional relationship between the leading vane 8A and the trailing vane 8B of each return vane 8 in the circumferential direction in the multistage centrifugal compressor 100 is described with reference to FIGS. 5 and 10. A circumferential angle γ illustrated in FIG. 5 indicates an angle formed in the circumferential direction by a straight line connecting the center line of the rotational shaft 4 to the trailing edge 8A2 of the leading vane 8A and a straight line connecting the center line of the rotational shaft 4 to the leading edge 8B2 of the trailing vane 8B. Meanwhile, FIG. 10 illustrates a pair of the leading vane 8A and the trailing vane 8B constituting each of the return vanes 8 in the first stage, an intermediate stage between the first stage and the last stage, and the last stage in the multistage centrifugal compressor 100 according to the present embodiment. The left side of FIG. 10 illustrates the first stage, a central portion of FIG. 10 illustrates the intermediate stage, and the right side of FIG. 10 illustrates the last stage. In addition, $\gamma_F$ illustrated on the left side of FIG. 10 represents the magnitude of the circumferential angle γ in the first stage, $\gamma_M$ illustrated in the central portion in FIG. 10 represents the magnitude of the circumferential angle γ in the intermediate stage, and $\gamma_L$ illustrated on the right side of FIG. 10 represents the magnitude of the circumferential angle γ in the last stage. As illustrated in FIG. 10, in the present embodiment, the leading vanes 8A and the trailing vanes 8B are configured such that (c) the magnitude of the circumferential angle γ is the largest in the first stage, gradually becomes smaller as the stage is located further downstream, and is the smallest in the last stage in the multistage centrifugal compressor 100. That is, the leading vanes 8A and the trailing vanes 8B are configured such that $\gamma_F > \gamma_M > \gamma_L$.

In the present embodiment, an effect of setting the magnitudes of the circumferential angles γ in the multistage centrifugal compressor 100 is as follows.

That is, to suppress the flow separation that occurs on the negative pressure surface 8B1 of each of the trailing vanes 8B, it is most effective to reduce the width of a flow path formed between the second half part of the pressure surface 8A1 of the leading vane 8A and the first half part of the negative pressure surface 8B1 of the trailing vane 8B as much as possible and direct the flow from the pressure surface 8A1 of the leading vane 8A toward the vicinity of the first half part of the vane in which a reduction in the flow velocity on the negative pressure surface 8B1 of the vane becomes largest and the flow separation easily occurs. On the other hand, when the width of the flow path formed between the second half part of the pressure surface 8A1 of the leading vane 8A and the negative pressure surface 8B1 of the trailing vane 8B is too narrow, it is necessary to use a small-diameter working tool to cut this portion, resulting in poor workability. Particularly, when the vane height (same as the width of the flow path of the return vane 8 in the meridional cross section) of this portion is large (the vane height is large in the first stage), it is necessary to use a tool with a small-diameter, a long tool length, and low rigidity in order to cut this portion. When the rigidity of the tool cannot be sufficiently secured, the tool deforms due to the insufficient rigidity when the tool is pressed against an object to be processed, and the object cannot be processed. Therefore, whether the width of the flow path formed between the second half part of the pressure surface 8A1 of the leading vane 8A and the first half part of the negative pressure surface 8B1 of the trailing vane 8B can be processed is determined according to the vane height in the vicinity of the second half part of the leading vane 8A and the first half part of the trailing vane 8B.

As described above, due to the compressibility of the fluid, the volumetric flow rate of the fluid flowing in the multistage centrifugal compressor 100 is the highest in the first stage and gradually decreases toward the last stage. The width of the flow path is adjusted according to the magnitude of the volumetric flow rate such that the flow velocity of the fluid flowing in the return vanes 8 is not too high. In a stage in which the volumetric flow rate is high, the leading vanes 8A and the trailing vanes 8B are configured such that the flow path has a large width, as compared with a stage in which the volumetric flow rate is low. Therefore, the leading vanes 8A and the trailing vanes 8B are configured such that the vane height in the vicinity of the second half part of each of the leading vanes 8A and the first half part of each of the trailing vanes 8B is the highest in the first stage and gradually becomes smaller toward the last stage. In this case, as in the present embodiment, when the circumferential angles γ are set such that $\gamma_F>\gamma_M>\gamma_L$, the width of the flow path formed between the second half part of the pressure surface 8A1 of each of the leading vanes 8A and the first half part of the negative pressure surface 8B1 of each of the trailing vanes 8B gradually becomes smaller toward the last stage from the first stage, and thus it is possible to set appropriate widths of the flow paths in consideration of both the suppression of the flow separation and the ensuring of the rigidity of the working tool.

Regarding the circumferential angles γ, when the Mach number of the fluid compressed by the multistage centrifugal compressor 100 is low and an effect of the compressibility of the fluid can be almost ignored, the circumferential angles γ in two or more adjacent stages among the stages of the multistage centrifugal compressor 100 may be set equal to each other. In other words, the leading vanes 8A and the trailing vanes 8B may be configured such that the circumferential angle γ in the first stage is the largest and the circumferential angle γ in the last stage is the smallest, when the first stage is compared with at least the last stage.

Figure 11:
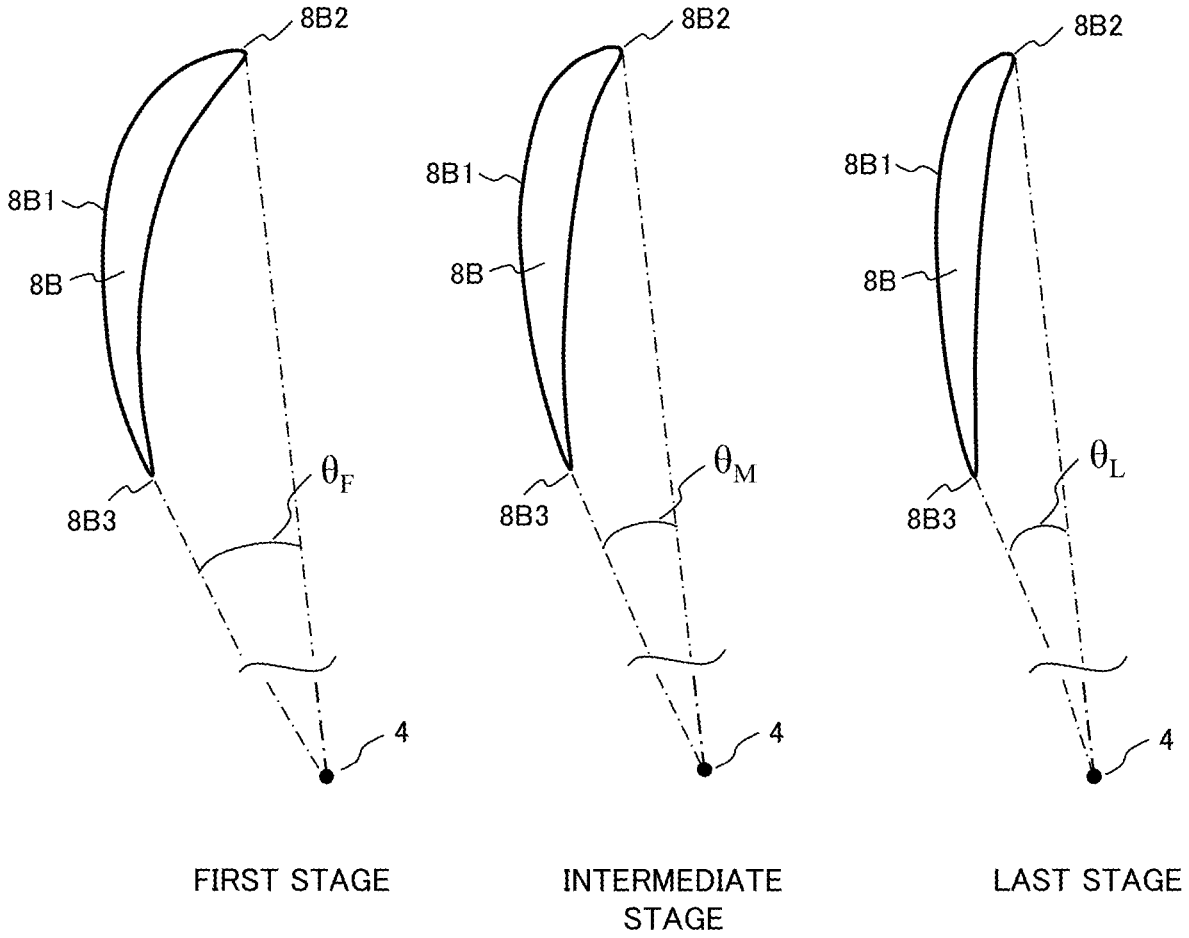
FIG. 11 is a diagram illustrating shape features of the trailing vanes of the return vanes in the first stage, the intermediate stage located between the first stage and the last stage, and the last stage according to the embodiment of the present invention.

Lastly, shape features of the trailing vanes 8B constituting the return vanes 8 of the multistage centrifugal compressor 100 according to the present embodiment are described with reference to FIGS. 5 and 11. A circumferential angle θ illustrated in FIG. 5 represents an angle formed in the circumferential direction by a straight line connecting the center line of the rotational shaft 4 to the leading edge 8B2 of the trailing vane 8B and a straight line connecting the center line of the rotational shaft 4 to the trailing edge 8B3 of the trailing vane 8B. Meanwhile, FIG. 11 illustrates shapes of the trailing vanes 8B constituting the return vanes 8 in the first stage, the intermediate stage between the first stage and the last stage, and the last stage of the multistage centrifugal compressor 100 according to the present embodiment. The left side of FIG. 11 illustrates the first stage, a central portion of FIG. 11 illustrates the intermediate stage between the first stage and the last stage, and the right side of the FIG. 11 illustrates the last stage. In addition, $\theta_F$ illustrated on the left side of FIG. 11 represents the magnitude of the circumferential angle θ in the first stage, $\theta_M$ illustrated in the central portion of FIG. 11 represents the magnitude of the circumferential angle θ in the intermediate stage, and $\theta_L$ illustrated on the right side of FIG. 11 represents the magnitude of the circumferential angle θ in the last stage. As illustrated in FIG. 11, in the present embodiment, (d) the magnitude of the circumferential angle θ is the largest in the first stage, gradually becomes smaller as the stage is located further downstream, and is the smallest in the last stage in the multistage centrifugal compressor 100. That is, the trailing vanes 8B are configured such that $\theta_F>\theta_M>\theta_L$.

In the present embodiment, an effect of setting the magnitudes of the circumferential angles θ in the multistage centrifugal compressor 100 is as follows.

As described above, to suppress the flow separation that occurs on the negative pressure surface 8B1 of the trailing vane 8B illustrated in FIG. 10, it is preferable that the width of the flow path formed between the second half part of the pressure surface 8A1 of each of the leading vanes 8A and the first half part of the negative pressure surface 8B1 of each of the trailing vanes 8B be reduced as much as possible. However, as described above, in the present embodiment, the leading vanes 8A and the trailing vanes B are configured such that the circumferential angle γ illustrated in FIG. 10 is the largest in the first stage, gradually becomes decreases as the stage is located further downstream, and is the smallest in the last stage in the multistage centrifugal compressor 100. Therefore, as illustrated in FIG. 10, the width of the flow path formed between the second half part of the pressure surface 8A1 of each of the leading vanes 8A and the first half part of the negative pressure surface 8B1 of each of the trailing vanes 8B is the largest in the first stage, gradually becomes smaller as the stage is located further downstream, and is the smallest in the last stage in the multistage centrifugal compressor 100. Therefore, the closer the flow is to the first stage of the multistage centrifugal compressor 100, the more easily the flow separation occurs on the negative pressure surface 8B1 of each of the trailing vanes 8B. It is more difficult for the flow separation to occur as the stage is located further downstream. As in the present embodiment, in a case where the trailing vanes 8B are configured such that the circumferential angles θ are set to satisfy $\theta_F>\theta_M>\theta_L$, as the stage of the multistage centrifugal compressor 100 is located further upstream, the chord line length L of each of the trailing vanes 8B can be ensured to be longer. Thus, the stage of the multistage centrifugal compressor 100 is located further upstream, a vane load applied to each of the trailing vanes 8B per unit length can be lower. Therefore, even in any of the stages of the multistage centrifugal compressor 100, it is possible to suppress the flow separation that occurs on the negative pressure surface 8B1 of each of the trailing vanes 8B.

Regarding the circumferential angles θ, when the Mach number of the fluid compressed by the multistage centrifugal compressor 100 is low and an effect of the compressibility of the fluid can be almost ignored, the circumferential angles θ in two or more adjacent stages among the stages of the multistage centrifugal compressor 100 may be equal to each other. In other words, the trailing vanes 8B may be configured such that the circumferential angle θ in the first stage is the largest and the circumferential angle θ in the last stage is the smallest, when the first stage is compared with at least the last stage.

As described above, according to the multistage centrifugal compressor 100 according to the present embodiment, while the outer diameter of the static flow path is reduced, it is possible to maintain and improve the efficiency. Therefore, a reduction in the cost and the improvement of the operational efficiency can be expected. In addition, due to the reduction in the outer diameter, an exclusive area in the centrifugal compressor 100 can be reduced.

The present invention is not limited to the above-described embodiments and includes various modifications.

For example, the embodiments are described above in detail to clearly explain the present invention and are not necessarily limited to include all the configurations described above. In addition, a part of the configuration according to a certain embodiment can be replaced with a configuration described in another embodiment. In addition, a configuration described in a certain embodiment can be added to a configuration described in another embodiment. In addition, a configuration can be added to, removed from, or replaced with a part of the configuration described in each embodiment.

For example, regarding (a) the maximum camber positions of the leading vanes, (b) the ratios of the maximum cambers to the lengths of the chord lines of the leading vanes, (c) the angles (circumferential angles γ) formed by the trailing edges of the leading vanes and the leading edges of the trailing vanes in the circumferential direction centered on the center line of the rotational shaft, and (d) the angles (circumferential angles θ) formed by the leading edges of the trailing vanes and the trailing edges of the trailing vanes in the circumferential direction centered on the center line of the rotational shaft, it suffices for at least one of the above-described features of (a), (c), and (d) to be provided. Needless to say, when any two of the features of (a), (c), and (d) or all of the features of (a), (c), and (d) are provided, a greater effect can be obtained.

LIST OF REFERENCE SIGNS

1 . . . Centrifugal impeller, 4 . . . Rotational shaft, 5 . . . Diffuser, . . . 6 . . . Return flow path, 7*a*, 7*b* . . . Turn section, 8 . . . Return vane, 8A . . . Leading vane of return vane, 8A1 . . . Pressure surface of leading vane of return vane, 8A2 . . . Trailing edge of leading vane of return vane, 8A3 . . . Leading edge of leading vane of return vane, 8A4 . . . Camber line of leading vane of return vane, 8A5 . . . Negative pressure surface of leading vane of return vane, 8A6 . . . Chord line of leading vane of return vane, 8A7 . . . Camber of leading vane of return vane, 8A8 . . . Maximum camber of leading vane of return vane, 8B . . . Trailing vane of return vane, 8B1 . . . Negative pressure surface of trailing vane of return vane, 8B2 . . . Leading edge of trailing vane of return vane, 8B3 . . . trailing edge of trailing vane of return vane, 8B4 . . . Pressure surface of trailing vane of return vane, 9 . . . Turn section inlet, 10 . . . Turn section outlet, 12 . . . Leading edge of return vane, 15 . . . Suction flow path, 16 . . . Discharge flow path, 19 . . . Casing, 20 . . . Diaphragm, 21*a*, 21*b* . . . Flange, 100 . . . Multistage centrifugal compressor, C . . . Absolute velocity, Cm . . . Meridional component of absolute velocity, Cu . . . Circumferential component of absolute velocity, $Cu_2$ . . . Circumferential component of absolute velocity of fluid at outlet of impeller, $H_{th}$ . . . Theoretical head, L . . . Chord line length, $U_2$ . . . Circumferential velocity of impeller, g . . . Gravitational acceleration, $I_{c,\ max}$ . . . Maximum camber position, β . . . Absolute flow angle, $\beta_{rtv}$ . . . Vane angle at trailing edge of trailing vane, θ . . . Angle formed by leading edge and trailing edge of trailing vane of return vane, $\theta_F$ . . . θ in first stage of multistage centrifugal compressor, $\theta_M$ . . . θ in intermediate stage between first stage and last stage of multistage centrifugal compressor, $\theta_L$ . . . θ in last stage of multistage centrifugal compressor, γ . . . Angle formed in circumferential direction by straight line connecting center line of rotational shaft to trailing edge of leading vane and straight line connecting center line of rotational shaft to leading edge of trailing vane, $\gamma_F$ . . . γ in first stage of multistage centrifugal compressor, $\gamma_M$ . . . γ in intermediate stage between first stage and last stage of multistage centrifugal compressor, $\gamma_L$ . . . γ in last stage of multistage centrifugal compressor

The invention claimed is:

1. A multistage centrifugal compressor comprising:

a rotational shaft; and a plurality of centrifugal impellers attached to the rotational shaft, wherein a plurality of centrifugal compressor stages are arranged in an axial direction of the rotational shaft, each of the centrifugal compressor stages including one of the centrifugal impellers, a diffuser in which a fluid that has flowed out of the one centrifugal impeller flows in a centrifugal direction away from the rotational shaft, a return flow path that is disposed downstream of the diffuser and in which the fluid flows in a return direction toward the rotational shaft so that the fluid flows from the diffuser to a centrifugal impeller in a subsequent stage among the plurality of centrifugal impellers, and a turn section that changes the flow of the fluid, which has flowed through the diffuser, from the centrifugal direction to the axial direction of the rotational shaft, and further changes the flow of the fluid from the axial direction to the return direction, each of the return flow paths includes a plurality of return vanes disposed in a circular cascade form centered on a center line of the rotational shaft, each of the return vanes includes a plurality of vanes arranged as a leading vane and a trailing vane in a direction from an upstream side to a downstream side of the flow of the fluid in each of the return flow paths, the trailing vanes are offset toward a pressure surface side of the leading vanes in a circumferential direction and provided so as to guide the flow on the pressure surface side of the leading vanes toward negative pressure surfaces of the trailing vanes, maximum camber positions of the leading vanes are changed according to the positions of the centrifugal compressor stages of the multistage centrifugal compressor, and the maximum camber positions of the leading vanes disposed in the return flow path in the centrifugal compressor stage on the most upstream side among the return vanes are located on the most trailing edge side, and the maximum camber positions of the leading vanes disposed in the return flow path in the centrifugal compressor stage on the most downstream side among the return vanes are located on the most leading edge side.

2. The multistage centrifugal compressor according to claim 1, wherein as the centrifugal compressor stage is located further downstream, the maximum camber positions of the leading vanes gradually become closer to the leading edges of the leading vanes.

3. The multistage centrifugal compressor according to claim 1, wherein in between the centrifugal compressor stage on the most upstream side and the centrifugal compressor stage on the most downstream side, the maximum camber position of each of the leading vanes in a certain downstream stage is the same as the maximum camber position of each of the leading vanes in a stage immediately upstream of the certain downstream stage.

4. The multistage centrifugal compressor according to claim 1, in any of the centrifugal compressor stages, the maximum camber position of each of the leading vanes is present on a second half part of a chord line of the leading vane.

5. The multistage centrifugal compressor according to claim 1, wherein, a ratio of a maximum camber to a length of a chord line of each of the leading vanes disposed in the return flow path in the centrifugal compressor stage on the most upstream side among the return vanes is the lowest, and a ratio of a maximum camber to a length of a chord line of each of the leading vanes disposed in the return flow path in the centrifugal compressor stage on the most downstream side among the return vanes is the highest.

6. The multistage centrifugal compressor according to claim 1, wherein, in any of the centrifugal compressor stages, the maximum camber position of each of the leading vanes is on a second half part of a chord line of the leading vane, and a ratio of a maximum camber to a length of a chord line of each of the leading vanes disposed in the return flow path in the centrifugal compressor stage on the most upstream side among the return vanes is the lowest, and a ratio of a maximum camber to a length of a chord line of each of the leading vanes disposed in the return flow path in the centrifugal compressor stage on the most downstream side among the return vanes is the highest.

7. The multistage centrifugal compressor according to claim 5, wherein as the centrifugal compressor stage is located further downstream, a ratio of a maximum camber to a length of a chord line of each of the leading vanes gradually becomes higher.

8. The multistage centrifugal compressor according to claim 5, wherein in between the centrifugal compressor stage on the most upstream side and the centrifugal compressor stage on the most downstream side, a ratio of a maximum camber to a length of a chord line of each of the leading vanes in a certain downstream stage is equal to a ratio of a maximum camber to a length of a chord line of each of the leading vanes in a stage immediately upstream of the certain downstream stage.

9. A multistage centrifugal compressor comprising:

a rotational shaft; and a plurality of centrifugal impellers attached to the rotational shaft, wherein a plurality of centrifugal compressor stages are arranged in an axial direction of the rotational shaft, each of the centrifugal compressor stages including one of the centrifugal impellers, a diffuser in which a fluid that has flowed out of the one centrifugal impeller flows in a centrifugal direction away from the rotational shaft, a return flow path that is disposed downstream of the diffuser and in which the fluid flows in a return direction toward the rotational shaft so that the fluid flows from the diffuser to a centrifugal impeller in a subsequent stage among the plurality of centrifugal impellers, and a turn section that changes the flow of the fluid, which has flowed through the diffuser, from the centrifugal direction to the axial direction of the rotational shaft, and further changes the flow of the fluid from the axial direction to the return direction, each of the return flow paths includes a plurality of return vanes disposed in a circular cascade form centered on a center line of the rotational shaft, each of the return vanes includes a plurality of vanes arranged as a leading vane and a trailing vane in a direction from an upstream side to a downstream side of the flow of the fluid in each of the return flow paths, the trailing vanes are offset toward a pressure surface side of the leading vanes in a circumferential direction and provided so as to guide the flow on the pressure surface side of the leading vanes toward negative pressure surfaces of the trailing vanes, and a circumferential angle γ formed by a trailing edge of each of the leading vanes and a leading edge of each of the trailing vanes in the circumferential direction centered on the center line of the rotational shaft is changed according to positions of the centrifugal compressor stages of the multistage centrifugal compressor, and the circumferential angle γ in each of the return vanes disposed in the return flow path in the centrifugal compressor stage on the most upstream side is the largest, and the circumferential angle γ in each of the return vanes disposed in the return flow path in the centrifugal compressor stage on the most downstream side is the smallest.

10. The multistage centrifugal compressor according to claim 9, wherein as the centrifugal compressor stage is located further downstream, the circumferential angle γ gradually becomes smaller.

11. The multistage centrifugal compressor according to claim 9, wherein in between the centrifugal compressor stage on the most upstream side and the centrifugal compressor stage on the most downstream side, the circumferential angle γ in a certain downstream stage is equal to the circumferential angle γ in a stage immediately upstream of the certain downstream stage.

12. The multistage centrifugal compressor according to claim 1, wherein a circumferential angle θ formed by a leading edge and a trailing edge of each of the trailing vanes in the circumferential direction centered on the center line of the rotational shaft in each of the return vanes disposed in the return flow path in the centrifugal compressor stage on the most upstream side is the largest, and a circumferential angle θ formed by a leading edge and a trailing edge of each of the trailing vanes in the circumferential direction centered on the center line of the rotational shaft in each of the return vanes disposed in the return flow path in the centrifugal compressor stage on the most downstream side is the smallest.

13. The multistage centrifugal compressor according to claim 12, wherein as the centrifugal compressor stage is located further downstream, the circumferential angle θ gradually becomes smaller.

14. The multistage centrifugal compressor according to claim 12, wherein in between the centrifugal compressor stage on the most upstream side and the centrifugal compressor stage on the most downstream side, the circumferential angle θ in a certain downstream stage is equal to the circumferential angle θ in a stage immediately upstream of the certain downstream stage.

15. The multistage centrifugal compressor according to claim 1, wherein circumferential angles θ formed by leading edges of the trailing vanes and trailing edges of the trailing vanes in the circumferential direction centered on the center line of the rotational shaft are changed according to the positions of the centrifugal compressor stages of the multistage centrifugal compressor, and vane angles $\beta_{rtv}$ at the trailing edges of the trailing vanes are set as "$\beta_{rtv} \cong 90°$" in the stages from the first stage to the last stage of the centrifugal compressor so as to orient the vane trailing edges toward the rotational shaft.

16. A multistage centrifugal compressor comprising:

a rotational shaft; and a plurality of centrifugal impellers attached to the rotational shaft, wherein a plurality of centrifugal compressor stages are arranged in an axial direction of the rotational shaft, each of the centrifugal compressor stages including one of the centrifugal impellers, a diffuser in which a fluid that has flowed out of the one centrifugal impeller flows in a centrifugal direction away from the rotational shaft, a return flow path that is disposed downstream of the diffuser and in which the fluid flows in a return direction toward the rotational shaft so that the fluid flows from the diffuser to a centrifugal impeller in a subsequent stage among the plurality of centrifugal impellers, and a turn section that changes the flow of the fluid, which has flowed through the diffuser, from the centrifugal direction to the axial direction of the rotational shaft, and further changes the flow of the fluid from the axial direction to the return direction, each of the return flow paths includes a plurality of return vanes disposed in a circular cascade form centered on a center line of the rotational shaft, each of the return vanes includes a plurality of vanes arranged as a leading vane and a trailing vane in a direction from an upstream side to a downstream side of the flow of the fluid in each of the return flow paths, the trailing vanes are offset toward a pressure surface side of the leading vanes in a circumferential direction and provided so as to guide the flow on the pressure surface side of the leading vanes toward negative pressure surfaces of the trailing vanes, circumferential angles θ formed by leading edges of the trailing vanes and trailing edges of the trailing vanes in the circumferential direction centered on the center line of the rotational shaft are changed according to the positions of the centrifugal compressor stages of the multistage centrifugal compressor, vane angles $\beta_{rtv}$ at the trailing edges of the trailing vanes are set as "$\beta_{rtv} \cong 90°$" in the stages from the first stage to the last stage of the centrifugal compressor so as to orient the vane trailing edges toward the rotational shaft, maximum camber positions of the leading vanes are changed according to the positions of the centrifugal compressor stages of the multistage centrifugal compressor, and the maximum camber positions of the leading vanes disposed in the return flow path in the centrifugal compressor stage on the most upstream side among the return vanes are located on the most trailing edge side, and the maximum camber positions of the leading vanes disposed in the return flow path in the centrifugal compressor stage on the most downstream side among the return vanes are located on the most leading edge side.

17. The multistage centrifugal compressor according to claim 16, wherein a circumferential angle θ formed by a leading edge and a trailing edge of each of the trailing vanes in the circumferential direction centered on the center line of the rotational shaft in each of the return vanes disposed in the return flow path in the centrifugal compressor stage on the most upstream side is the largest, and a circumferential angle θ formed by a leading edge and a trailing edge of each of the trailing vanes in the circumferential direction centered on the center line of the rotational shaft in each of the return vanes disposed in the return flow path in the centrifugal compressor stage on the most downstream side is the smallest.

18. The multistage centrifugal compressor according to claim 16, wherein a ratio of a maximum camber to a length of a chord line of each of the leading vanes disposed in the return flow path in the centrifugal compressor stage on the most upstream side among the return vanes is the lowest, and a ratio of a maximum camber to a length of a chord line of each of the leading vanes disposed in the return flow path in the centrifugal compressor stage on the most downstream side among the return vanes is the highest.

* * * * *